US010716725B2

(12) United States Patent
Comunale

(10) Patent No.: US 10,716,725 B2
(45) Date of Patent: Jul. 21, 2020

(54) DISPOSABLE BIO-SECURE ENVIRONMENTAL UNIT

(71) Applicant: Mark E. Comunale, Temecula, CA (US)

(72) Inventor: Mark E. Comunale, Temecula, CA (US)

( * ) Notice: Subject to any disclaimer, the term of this patent is extended or adjusted under 35 U.S.C. 154(b) by 0 days.

(21) Appl. No.: 14/756,979

(22) Filed: Nov. 4, 2015

(65) Prior Publication Data

US 2019/0388290 A1 Dec. 26, 2019

(51) Int. Cl.

| | |
|---|---|
| ***A61G 10/00*** | (2006.01) |
| ***A61G 10/02*** | (2006.01) |
| *A61G 1/04* | (2006.01) |

(52) U.S. Cl.

CPC ..... *A61G 10/005* (2013.01); *A61G 10/02* (2013.01); *A61G 1/04* (2013.01)

(58) Field of Classification Search

CPC . A61G 1/04; A61G 10/02; A61G 7/05; A61G 10/005

See application file for complete search history.

(56) References Cited

U.S. PATENT DOCUMENTS 6,321,764 B1 * 11/2001 Gauger ..... A61G 1/0212 135/128

2006/0020159 A1 * 1/2006 Ellen ..... A61G 10/005 600/21

* cited by examiner

*Primary Examiner* — Christine H Matthews
*Assistant Examiner* — Joshua Daryl D Lannu
(74) *Attorney, Agent, or Firm* — Morris Pollack; Luis Figarella

(57) ABSTRACT

This invention provides a novel blending and application of technologies that creates a low cost, disposable bio-secure environment to temporarily hold, and where required to transport, patients who are suspected of having an infectious or contagious disease requiring contact isolation precautions. Upon initial presentation of such patients, health care facilities are able to hold such patients while they are initially assessed and then, if need be, transported to an appropriate biosafety level unit. The described Environmental Unit differs significantly from current products in many ways. The unique design provides a unit that is disposable and relatively inexpensive. The frame is designed to integrate with hospital stretchers and beds. The unit is large enough for a patient to sit up and allows movement of arms and legs and the ability to eat and drink while isolated on a bed.

3 Claims, 9 Drawing Sheets

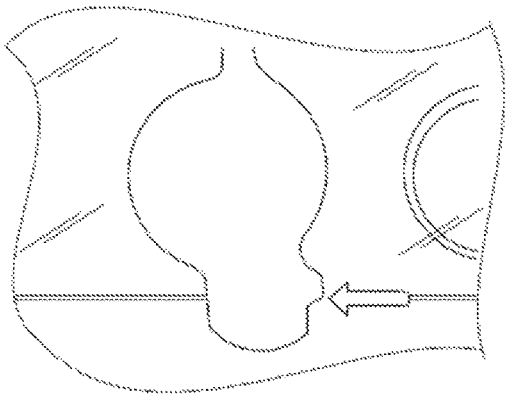
Figure 8
Figure 9
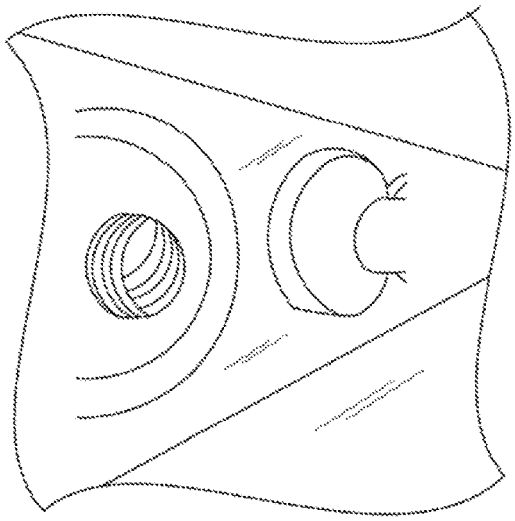

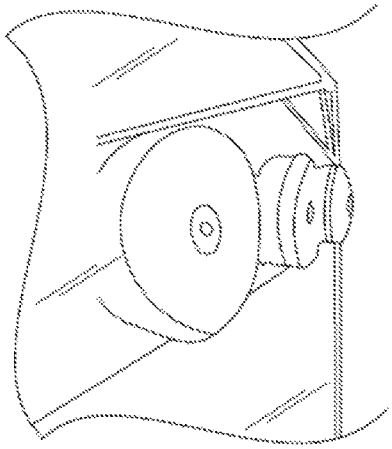
Figure 10
Figure 11
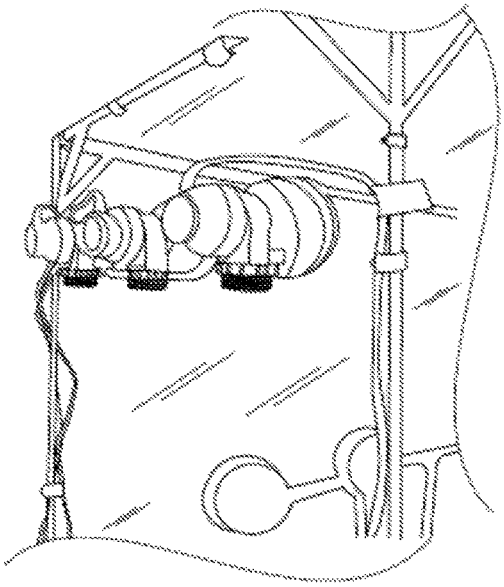

DISPOSABLE BIO-SECURE ENVIRONMENTAL UNIT

CROSS-REFERENCE TO RELATED APPLICATIONS

This application is related to and claims priority from U.S. Provisional Application No. 62/122,968 filed on Nov. 3, 2014 and U.S. Provisional Application No. 62/178,447 filed on Apr. 11, 2015, the entire contents of which are hereby incorporated by reference herein.

FIELD OF APPLICATION

This invention relates to patients that are suspected of infectious and/or contagious disease; and, more particularly to such patients seeking entrance to a hospital, clinic, doctor's office, or similar facility.

BACKGROUND OF THE INVENTION—DESCRIPTION OF PRIOR ART

Many hospitals, clinics, doctor's offices, and other such facilities have found it necessary to screen for ebola and other contagious diseases once a patient seeking entrance to the facility says "yes" to screening questions, concerning ebola and/or such other contagious diseases. The respective staff must don appropriate Personal Protective Equipment (PPE) and must have a place, such as an anteroom, available to dress and undress. At that time there also arises a need for a patient transport unit that facilitates transport of such a patient.

Patient isolation units, such as the one shown and described in U.S. Pat. No. 6,966,937 to Takashi Yachi, et al, require use of a sheet of flammable resin as part of a tent within which a patient can be examined. The erection of the tent is time consuming. It's flammability may prove to be unacceptable and dangerous due to it's flammability.

U.S. Pat. No. 9,038,214, issued on May 26, 2015, on the other hand, provides a plurality of privacy screens that are to be hung about a bed or gurney to accommodate HIPPA requirements. The illustrated and described screens are unacceptable because the patient cannot see out, nor can attending medical personnel see in or attend to the patient without displacing one or more of the screens.

U.S. Pat. No. 9,155,309, issued on Oct. 13, 2015 is directed to a virus inactivating sheet and would prove unacceptable for patients seeking entry to a medical facility

SUMMARY OF THE INVENTION

Therefore, it is an object of the invention, to provide a new and novel Environmental Unit;

It is another object of the invention, to provide a new and novel bio-secure Environmental Unit;

It is still another object of this invention, to provide a new and novel disposable bio-secure Environmental Unit;

It is yet another object of this invention, to provide a new and novel transport;

It is yet still another object of this invention, to provide a new and novel transport for a patient seeking entry to a hospital, clinic, Dr's office, or other medical facility;

It is yet still another object of this invention, to provide a new and novel transport for a patient seeking entry to a hospital, clinic, Dr's office, or other medical facility that responds positively to questions concerning contagious and/or infectious diseases;

It is yet still another object of this invention, to provide a new and novel transport for a patient seeking entry to a hospital, clinic, Dr's office, or other medical facility that responds positively to questions concerning contagious and/or infectious diseases;

It is yet still another object of this invention, to provide a new and novel transport for a patient that permits seeing the patient, while the patient is disposed within the Environmental Unit;

It is yet still another object of this invention, to provide a new and novel transport for a patient that permits attending to patient needs, while the patient is disposed within the Environmental Unit;

It is yet still another object of this invention, to provide a new and novel transport for a patient that is attachable to a gurney, stretcher, hospital bed or the like;

It is yet still another object of this invention, to provide a new and novel transport for a patient that permits seeing the patient, while the patient is disposed within the Environmental Unit;

The hereinafter described invention provides a novel blending and application of technologies to create a low cost, disposable bio-secure environment to temporarily hold, and where required to transport, patients who are suspected of having an infectious or contagious disease requiring contact isolation precautions. Upon initial presentation of such patients, health care facilities are able to hold such patients while they are initially assessed and then, if need be, transported to an appropriate biosafety level unit. The described Environmental Unit differs significantly from current products in many ways. The design is unique because it is disposable and relatively inexpensive. The frame is designed to integrate with hospital stretchers and beds. The unit is large enough for a patient to sit up and allows movement of arms and legs and the ability to eat and drink while isolated on a bed.

The Unit utilizes the same technology as a Power Air Purifying Respirator (PAPR); which is an already-existing technology that is used to purify air. The unit may be reasonably stored for use adjacent a hospital's Emergency Room entrance for easy access, but it can also be moved to the front entrance to the hospital or to a Medical Office Building. The Unit may also be used as an integral part of trauma and emergency services.

BRIEF DESCRIPTION OF THE DRAWINGS

Some of the objects of the invention have been set out above. Other objects and advantages of the invention will appear as the description proceeds when taken in conjunction with the following drawings:

FIGS. 8, 9, 10 and 11 are perspective showings of preparation of the PAPR motors of the environmental transport unit of FIG. 4 in further preparation of the environmental transport to receive a patient;

DESCRIPTION OF THE PREFERRED EMBODIMENTS

Figure 1:
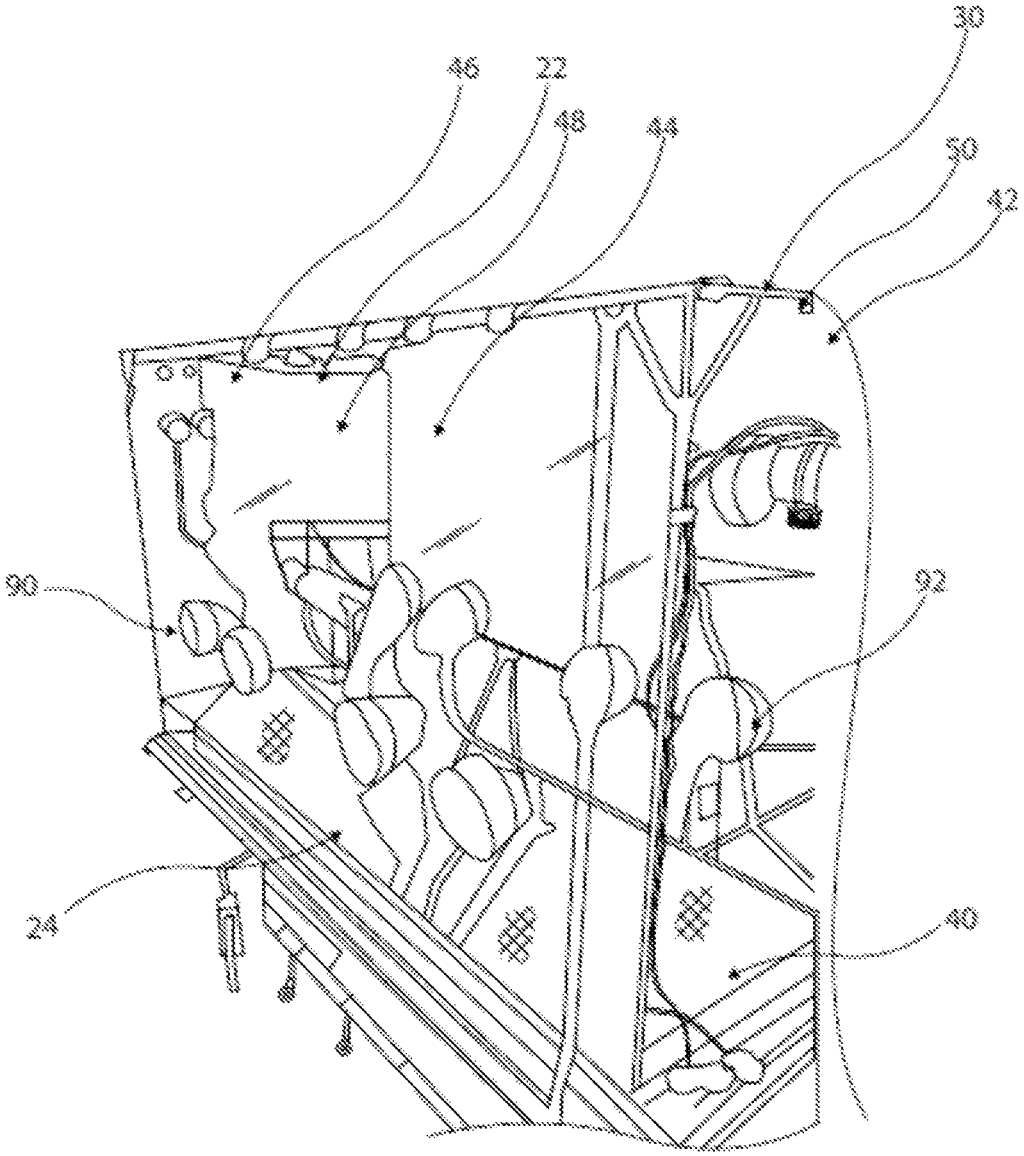
FIG. 1 is a perspective showing of a disposable bio-secure environmental transport unit incorporating the instant invention.
Figure 2:
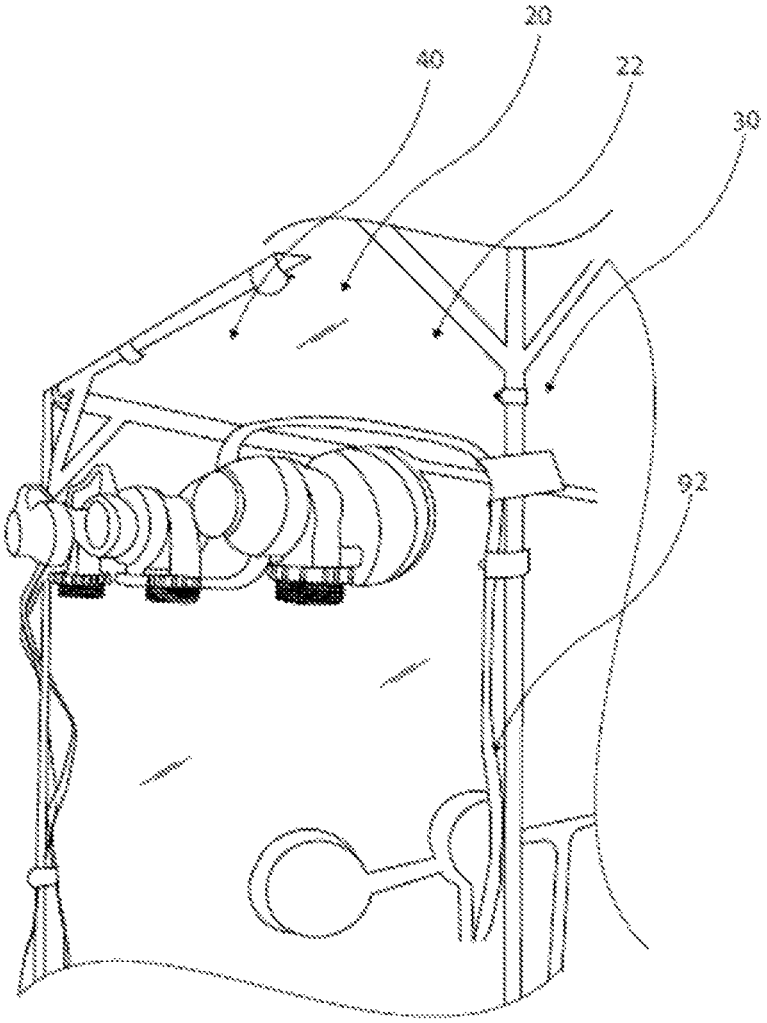
FIG. 2 is a perspective showing of a positioning for the PAPR motors utilized for the environmental transport unit of FIG. 1.
Figure 3:
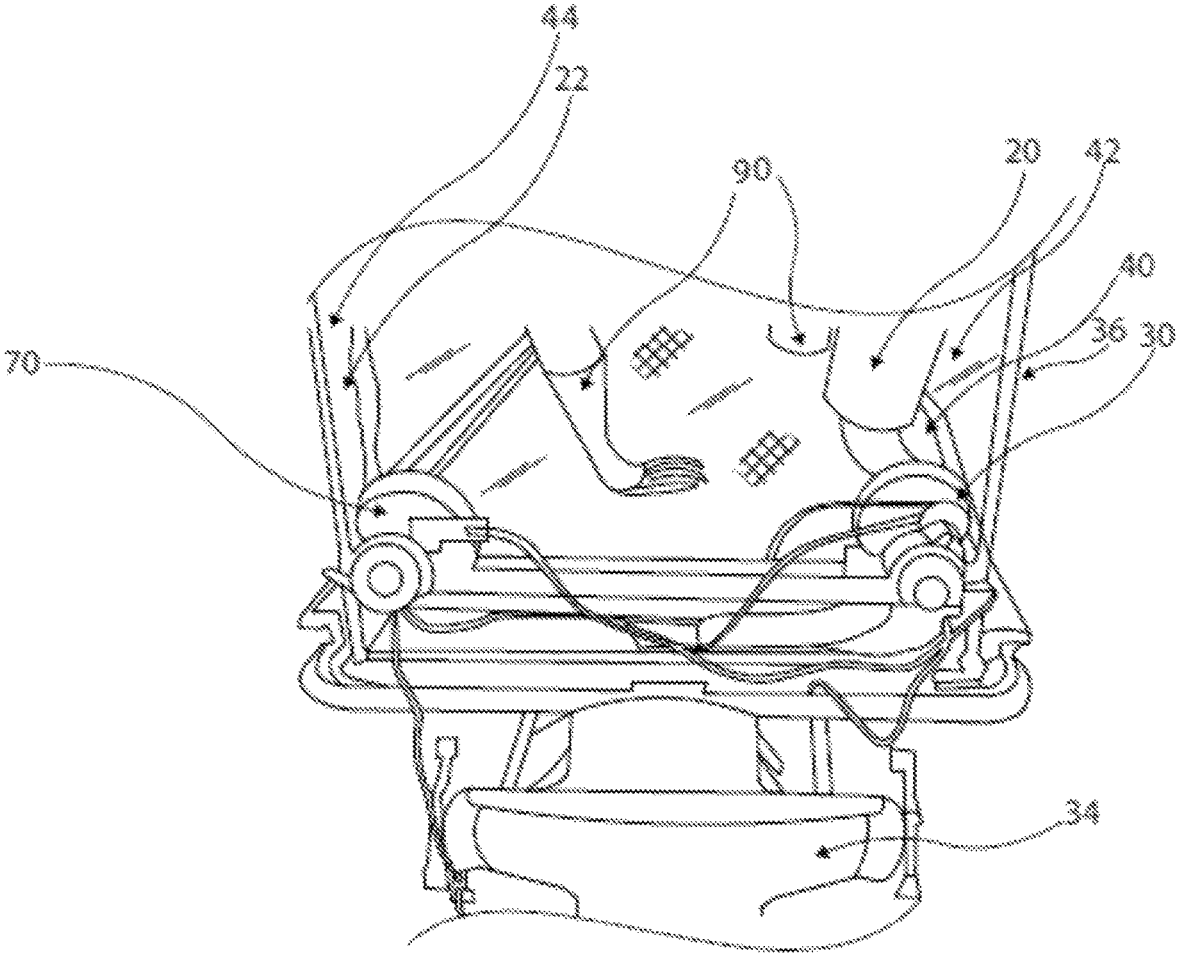
FIG. 3 is a perspective showing of an end of the environmental transport unit of FIG. 1.
Figure 4:
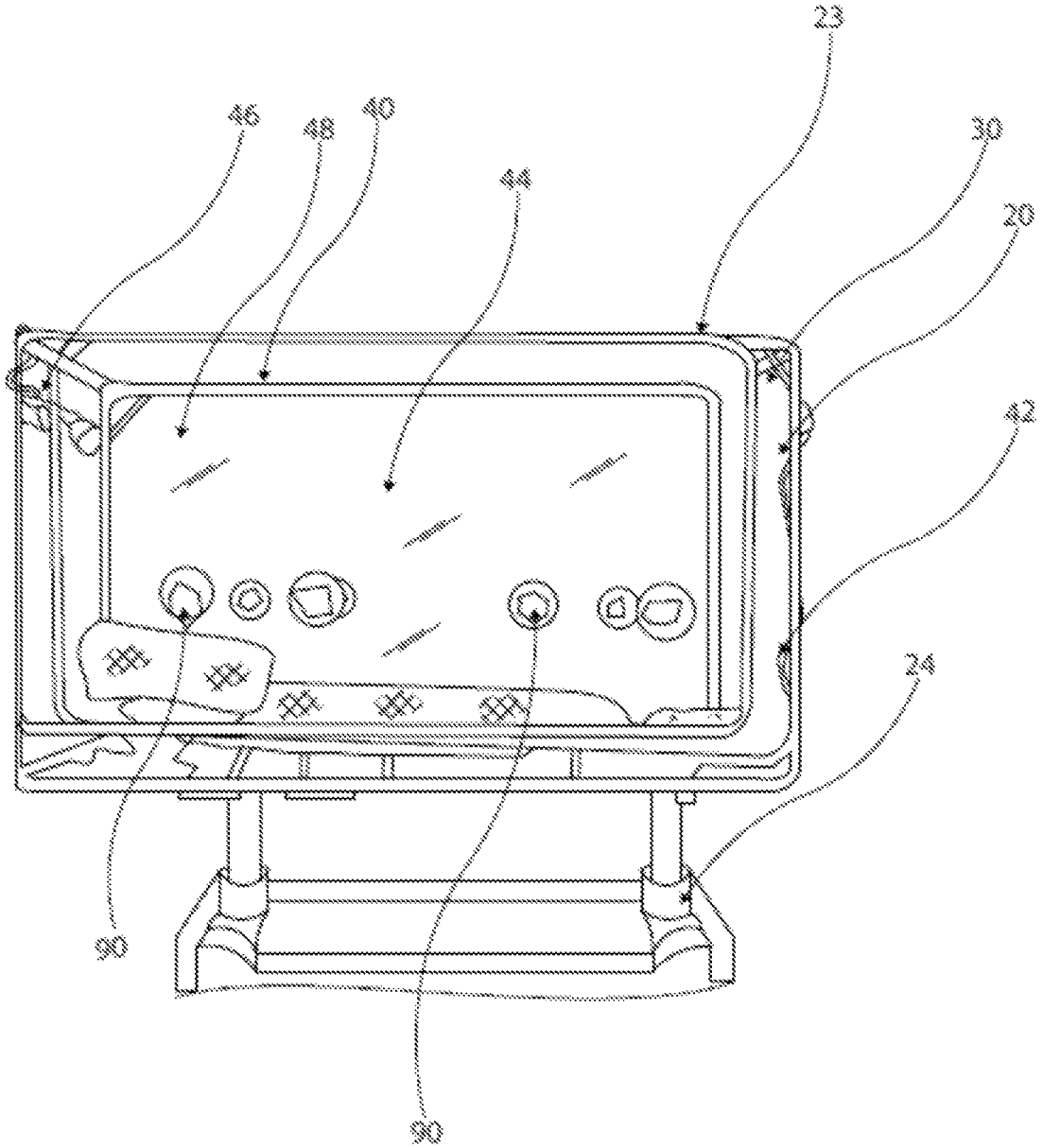
FIG. 4 is a perspective front elevational showing of the environmental transport unit of FIG. 1 but equipped to receive a patient.
Figure 5:
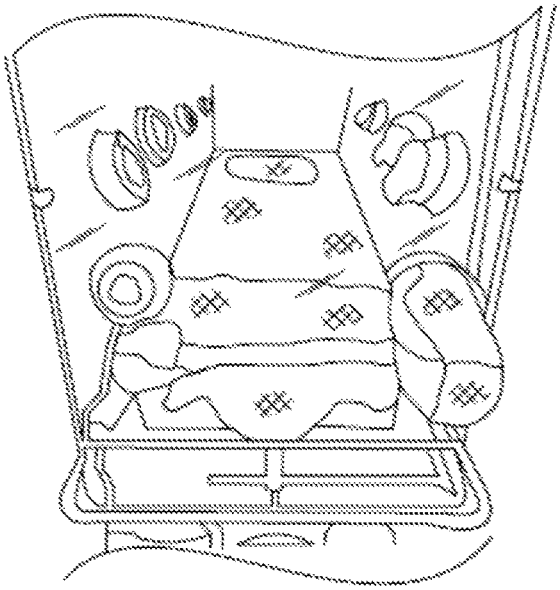
FIG. 5 is a perspective front elevational showing of the environmental transport unit of FIG. 1 in the process of being prepared to receive a patient.
Figure 6:
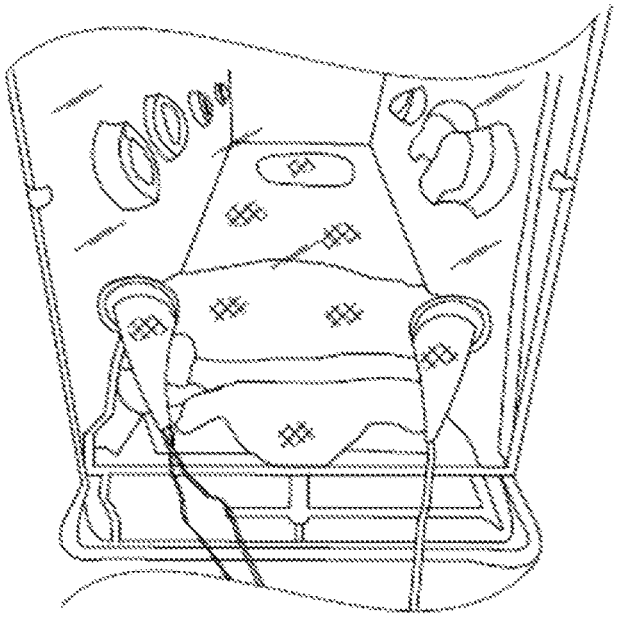
FIG. 6 is a perspective front elevational showing of the environmental transport unit of FIG. 5 further along in the process of being prepared to receive a patient.
Figure 7:
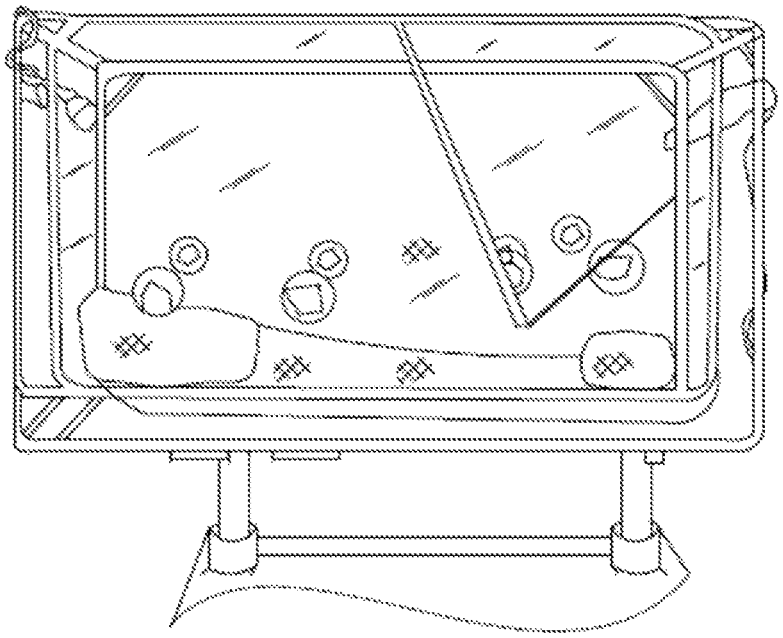
FIG. 7 is a perspective front elevational showing of the environmental transport unit of FIG. 4 with an entry closure opened to facilitate further preparation of the environmental transport to receive a patient.

With reference to FIGS. 1-4 and 13 there is generally shown at 20 a bio-disposable environmental transport incorporating the instant invention. Transport 20 includes a containment tent 22 positioned and secured in place on top of a gurney 24. While transport 20 has been shown positioned on a gurney 24 it may also be so positioned on a stretcher, hospital bed, or other structure constructed to receive cabin 22 or the like.

A. rigid frame 30 of containment tent 22 integrates easily onto gurney 24, or a stretcher, or other available and fitted out platform. Containment tent 22, is bio-disposable with a 20 mil clear poly plastic floor 40, walls 42, 44, 46, & 48 and ceiling 50 and is easily secured onto frame 30.

Figure 12:
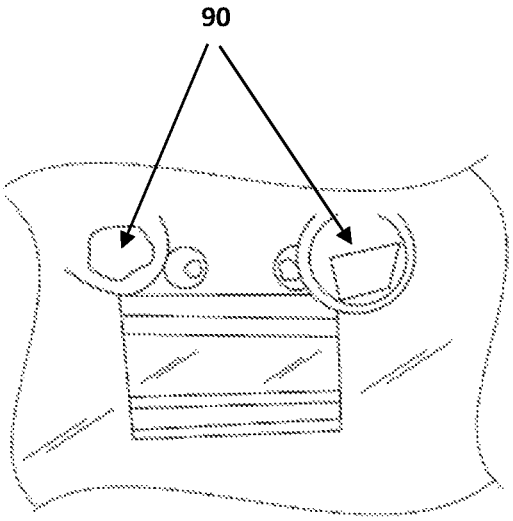
FIG. 12 is a perspective front elevational showing of the transfer pocket of the environmental transport unit of the instant invention.
Figure 13:
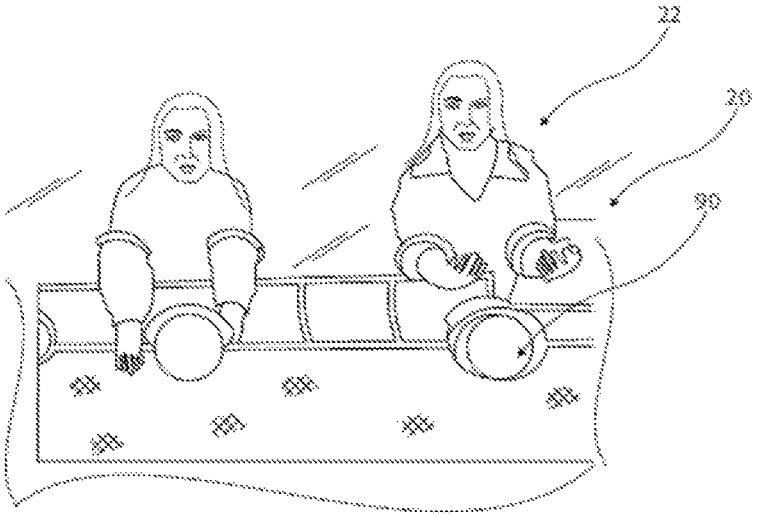
FIG. 13 is a perspective front elevational showing of the environmental transport unit of the instant invention showing a patient positioned within the cabin of the unit.
Figure 14:
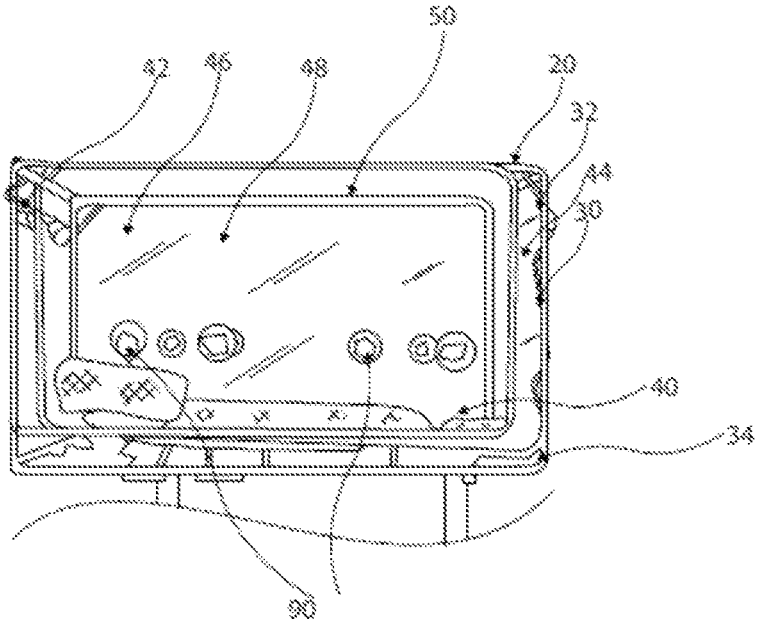
FIG. 14 is a perspective front elevational showing of the environmental transport unit of the instant invention showing access of attendants to the inside of the cabin of the environmental transport unit.

An Integrated pass through isolation pouch 60 (FIG. 12) is provided for moving supplies into, and out from, containment tent 22.

Also incorporated for the Unit is an Integrated battery powered negative or positive pressure ventilation system 70 (FIG. 3) with HEPA filtered exhaust. Air flow rate 13.1 changes per hour.

A large zippered patient entry door 80 (FIG. 9C) with Velcro seal folds downward when open to protect the stretcher and containment tent 22 and Environmental Unit 50 during patient entry and exit.

Multiple integrated sealed port glove access 90 (FIGS. 1, 2, 4, and 12-14) are provided for patient care processes.

an integrated IV bag holder is also provided.

Ports 94, 96, etc. are provided for monitoring cables, oxygen and IV tubing.

FIGS. 5-12 facilitate, describe, and illustrate the setup of, and guide use of, an example of an Isolation Gurney Environmental Unit incorporating the instant invention.

An example of use and operation of the Environmental Unit is as follows:

Firstly the person setting up the Environmental Unit (DR. Nurse, Technician, or other person assigned and assisting personnel should assemble the: transport monitor and cords; blood pressure cuff; ECG electrodes (for chest); Pulse Ox probe; oxygen tubing; nasal canula; and IV tubing (if needed).

Next the cords need to be placed by: opening the port located at the head of the gurney; pulling the lining outward; thread monitoring cords through the port; twist the lining around the cords; tape the lining to the cords forming a seal; push the cords and lining inward; ensure all monitoring probes are connected to cords; repeat process for Oxygen and IV tubing on the second port.

The gurney, already prepared with an Environmental Unit, is opened by: downwardly unzipping each zipper located on the right and left side of the isolation gurney; grabbing the Velcro located at the top of the Environmental Unit and pulling the Velcro apart and allowing the isolation unit closure to fall downward.

Next obtain 3 PAPR batteries from the charging station and clip the batteries to the bar located at the foot of the gurney. Remove storage caps prior to operating the PAPR. Outer caps are located toward the bottom of the motor on the outside of the PAPR. Twist the cap clockwise to remove the cap. Inner caps should be pulled outward to remove the cap. Repeat the process for all 3 motors. Connect each battery to the PAPR motor. On the battery, turn the knob to the on position and the motor will begin pulling air into the isolation gurney. For the head of the Isolation Gurney remove storage caps located on the outside and inside portions of the isolation gurney. Inside caps should be twisted clockwise and removed. Outside caps should be pulled outwards and removed.

The isolation Gurney is now ready for use for a patient.

The patient should have been or should now be Informed of the use of the Isolation transport unit in order to facilitate transport to an isolation unit.

Ensure the Isolation gurney is open by unzipping downwardly the isolation unit closure zippers located on the right and left side of the closure. The Velcro located at the top of the isolation unit should be pulled apart and the isolation door should fall downward.

The patient should next enter the isolation gurney. Closing the isolation containment tent 22 closure Is accomplished by grabbing the closure and attaching it's Velcro to the Velcro at the top of the unit. A strong adhesion of the Velcro is effected by pressing down on each portion of the Velcro. Each zipper, located on the right and left side of the closure is zipped upward.

The transfer pocket is available in the event a patient needs additional supplies. Objects may be passed into containment tent 22 by opening the outside zipper to the transfer pocket. The object is placed into the pocket the pocket is zipped closed. The patient thereafter unzips the inside pocket and can obtain the item; thereafter zipping the pocket closed. It is important to ensure that the patient zips the inside pocket closed.

What is claimed is:

1. A disposable bio-secure environmental transport comprising;

a patient transporter;

a reusable, adjustable frame;

a containment tent for a patient seeking entry to a hospital, clinic, a Doctor's office or medical facility;

wherein the patient may have a contagious disease;

one or more battery powered negative pressure ventilators mechanically attached to said frame, one or more of said ventilators having pneumatic access to an interior volume of said containment tent; and said containment tent being designed and constructed to be positioned on top of and secured to said patient transporter and having one or more sealable openings, to include a side opening extending along a side and top of one side panel, forming a flap when opened, so that said flap falls over a side of said patient transporter when open.

2. A disposable bio-secure environmental transport unit comprising:

a reusable, adjustable support frame defining a volume;

a collapsible containment tent having a ceiling, a bottom and at least four side panels forming a single enclosure, said containment tent having two or more sealable openings along sides or ceiling of said containment tent, said containment tent being mechanically linked to said reusable, adjustable support frame through adjustable components;

wherein one or more of said sealable openings are comprised of a side opening extending along a vertical length and top of one side panel of the at least four side panels to form a flap, so that when one of said sealable openings is opened, said flap falls over a side of the one side panel; and one or more battery powered negative pressure ventilators mechanically attached to said frame, one or more of said ventilators having pneumatic access to an interior volume of said containment tent.

3. The disposable unit of claim 2 wherein:

said containment tent has an internal height that is approximately half of an internal length of said containment tent.

* * * * *